US008220072B2

(12) United States Patent
Dodd

(10) Patent No.: US 8,220,072 B2
(45) Date of Patent: Jul. 17, 2012

(54) PROTECTIVE SHIN GUARD

(75) Inventor: Mark D. Dodd, Allen, TX (US)

(73) Assignee: The Dodd Group, LLC, Allen, TX (US)

( * ) Notice: Subject to any disclaimer, the term of this patent is extended or adjusted under 35 U.S.C. 154(b) by 1781 days.

(21) Appl. No.: 11/057,954

(22) Filed: Feb. 15, 2005

(65) Prior Publication Data

US 2006/0179538 A1 Aug. 17, 2006

(51) Int. Cl.
*A41D 13/00* (2006.01)

(52) U.S. Cl. ..... 2/22

(58) Field of Classification Search ..... 2/16, 22–24, 2/44, 45, 267, 455, 911; 128/882, 892; 602/23, 602/60, 61, 62
See application file for complete search history.

(56) References Cited

U.S. PATENT DOCUMENTS

| | | | | | |
|---|---|---|---|---|---|
| 1,243,230 | A | | 10/1917 | Smith | |
| 1,683,226 | A | | 9/1928 | Zuck | |
| 3,514,784 | A | | 6/1970 | McDavid | |
| 3,528,412 | A | | 9/1970 | McDavid | |
| 3,772,704 | A | | 11/1973 | Carbonneau | |
| 3,867,239 | A | | 2/1975 | Alesi et al. | |
| 4,115,902 | A | | 9/1978 | Taylor | |
| 4,191,192 | A | | 3/1980 | McDavid | |
| 4,272,850 | A | | 6/1981 | Rule | |
| 4,306,315 | A | * | 12/1981 | Castiglia | 2/22 |
| 4,538,301 | A | | 9/1985 | Sawatzki et al. | |
| 4,805,606 | A | | 2/1989 | McDavid, III | |
| 4,870,956 | A | | 10/1989 | Fatool et al. | |
| 4,923,728 | A | | 5/1990 | Snedeker | |
| 5,007,111 | A | | 4/1991 | Adams | |
| 5,105,473 | A | | 4/1992 | Valtakari | |
| 5,301,370 | A | | 4/1994 | Henson | |
| 5,477,558 | A | | 12/1995 | Volker et al. | |
| 5,518,802 | A | | 5/1996 | Colvin et al. | |
| 5,581,805 | A | | 12/1996 | Rennick | |
| 5,625,896 | A | * | 5/1997 | LaBarbera et al. | 2/22 |
| 5,680,657 | A | | 10/1997 | Valtakari | |
| 5,689,836 | A | | 11/1997 | Fee et al. | |
| 5,797,865 | A | | 8/1998 | McDavid, III | |
| 5,890,224 | A | * | 4/1999 | Clark | 2/22 |
| 5,915,528 | A | * | 6/1999 | Shmuelov | 2/2.5 |
| 5,926,844 | A | * | 7/1999 | Bear | 2/22 |
| 6,058,503 | A | * | 5/2000 | Williams | 2/16 |
| 6,094,743 | A | | 8/2000 | Delgado | |
| 6,286,150 | B1 | | 9/2001 | Miller et al. | |
| 6,295,654 | B1 | | 10/2001 | Farrell | |
| 6,507,955 | B1 | | 1/2003 | Fee et al. | |
| 6,519,781 | B1 | | 2/2003 | Berns | |
| D472,678 | S | | 4/2003 | Cho | |

(Continued)

OTHER PUBLICATIONS

TEKNOR APEX Thermoplastic Elastomer Division; "Monprene TPE"; pp. 1-8; Jul. 2004; www.teknorapex.com.

(Continued)

*Primary Examiner* — Tejash Patel
(74) *Attorney, Agent, or Firm* — Patent Capital Group

(57) ABSTRACT

A protective guard for reducing injury to a shin of a person is provided. The protective guard includes an elastomeric substrate having a pocket disposed therein. A central core is carried by the pocket of the elastomeric substrate. The central core includes a plurality of rigid plates, a first of which is joined by at least one hinge to a second of the plates.

13 Claims, 3 Drawing Sheets

U.S. PATENT DOCUMENTS

| | | | | |
|---|---|---|---|---|
| 6,589,891 | B1 | 7/2003 | Rast | |
| 6,654,960 | B2 | 12/2003 | Cho | |
| 6,726,641 | B2 | 4/2004 | Chiang et al. | |
| 6,807,891 | B2 | 10/2004 | Fisher | |
| 7,093,301 | B1 * | 8/2006 | Moore, Jr. | 2/2.5 |
| D582,608 | S | 12/2008 | Palmer | |
| D610,312 | S | 2/2010 | Farrell | |
| D617,503 | S | 6/2010 | Szalkowski et al. | |
| 2004/0019950 | A1 | 2/2004 | Rast | |
| 2009/0276933 | A1 | 11/2009 | Dodd | |
| 2011/0113559 | A1 | 5/2011 | Dodd | |

OTHER PUBLICATIONS

PCT International Search Report dated Jul. 3, 2008.

* cited by examiner

PROTECTIVE SHIN GUARD

BACKGROUND OF THE INVENTION

1. Field of the Invention

The present invention relates generally to protective equipment and in particular to protective guards for extremities such as shins to be worn while engaging in sports activities.

2. Description of Related Art

Shin guards are widely used in amateur and professional soccer to protect players' lower legs and shins from impact with other players. In soccer, since players advance the soccer ball through kicking, players are frequently kicked in the shin and lower leg by other players. Without adequate protection, the risk of injury is high.

Existing shin guards provide some protection for the shins of soccer players, but the guards are typically bulky and uncomfortable. The existing shin guards are typically a single piece of rigid plastic and are secured to the shin and lower leg using straps or special sleeves. While the existing shin guards are manufactured in different sizes, obtaining a "custom" fit is almost impossible, and the shin guards often protrude outward from each side of the player's leg. The lack of custom sizing available with existing shin guards makes them less comfortable to wear, and the guards could under some circumstances impede the movement of the player. Finally, a guard that does not fit properly also fails to provide maximum impact protection to the player.

A need exists, therefore, for a protective guard that provides a customized fit to a person's leg or other body part. A protective guard is further needed that is easily adjustable to extremities of different sizes and shapes so that a minimum number of sizes can be manufactured. Finally, a protective guard is needed that is easy to manufacture and is comfortable to wear during extended periods of exertion.

BRIEF SUMMARY OF THE INVENTION

The problems presented by existing protective guards are solved by the protective guard of the present invention. The protective guard includes an elastomeric sheath having a pocket disposed therein. The protective guard further includes a central core having a plurality of rigid plates. The central core is disposed within the pocket of the elastomeric sheath. The plurality of rigid plates includes a first plate that is joined by at least one hinge to a second plate.

Also in accordance with the principles of the present invention, a protective guard having a conformable substrate and a plurality of core members is provided. The plurality of core members are at least partially embedded within the conformable substrate. The core members are arranged such that a first of the core members is rotationally movable about at least one axis relative to a second of the core members.

Also in accordance with the principles of the present invention, a protective guard is provided that includes a conformable substrate and a plurality of core members disposed adjacent to a surface of the conformable substrate. The core members are arranged such that a first of the core members is rotationally movable about at least one axis relative to a second of the core members.

Also in accordance with the principles of the present invention, a protective guard is provided that includes an elastomeric substrate and a plurality of non-elastomeric core members. The non-elastomeric core members are at least partially embedded within the elastomeric substrate.

Other objects, features, and advantages of the present invention will become apparent with reference to the drawings and detailed description that follow.

DETAILED DESCRIPTION OF THE PREFERRED EMBODIMENT

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, chemical, and material changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

As used herein, the term "elastomer" refers to a polymeric or rubber (natural or synthetic) material that has elongation rates greater than 100%.

The term "conformable" refers to the ability of a material to be shaped to the contours of a surface without permanently deforming or setting the material. The conformable material could be placed adjacent to a first surface to provide a contour fit to the first surface, and then could subsequently be placed adjacent a second surface and similarly provide a contour fit to the second surface.

Figure 1:
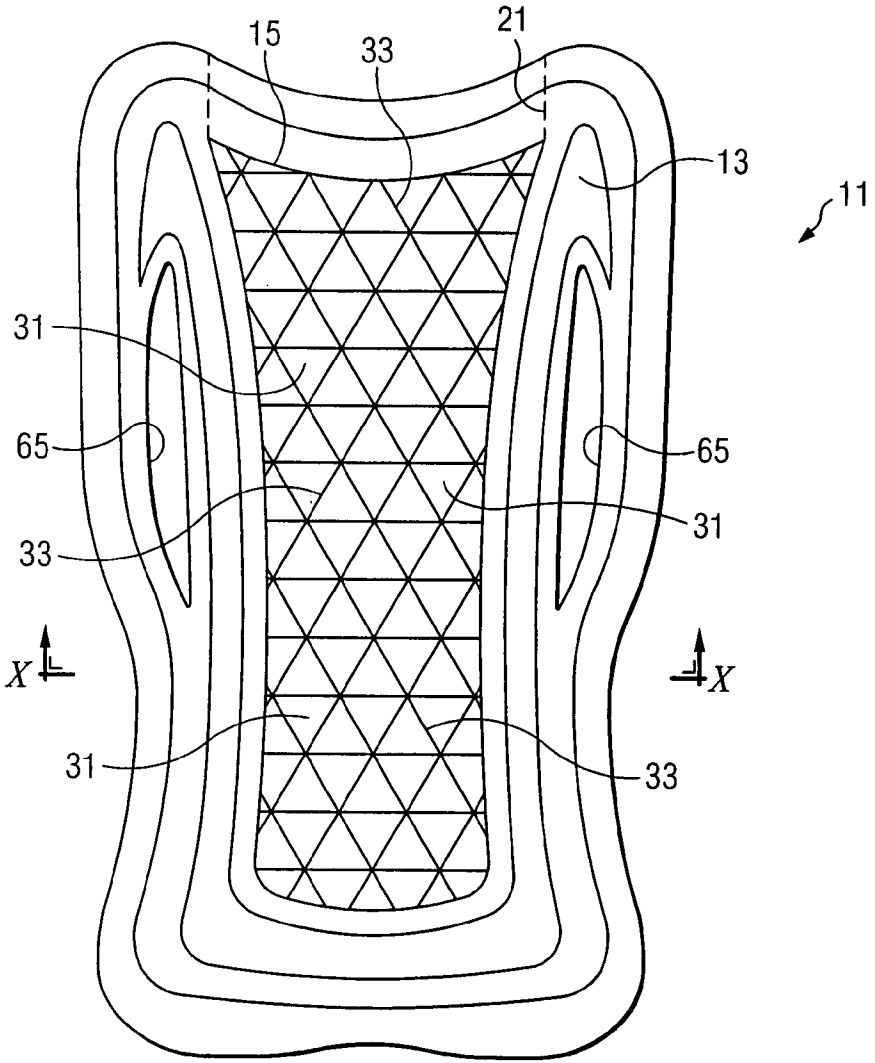
FIG. 1 illustrates a front view of a protective guard according to the present invention, the protective guard having a conformable substrate and a central core disposed therein.

Referring to FIG. 1, a protective guard 11 according to the principles of the present invention includes a conformable substrate 13 and a central core 15. The central core 15 is connected to or embedded within the conformable substrate 13 to provide impact protection to a body part of a person. The conformable substrate 13 preferably includes a pocket 19 (see FIG. 10) within the conformable substrate that houses the central core 15. When the central core 15 is contained within pocket 19, the conformable substrate 13 functions as a sheath, and an entry slot 21 may be optionally provided to allow access to pocket 19, thereby allowing the central core 15 to be selectively removed or inserted into the conformable substrate 13. However, it is preferable that the pocket 19 is not accessible by an entry slot, thereby creating a sealed space for the conformable substrate 13. The pocket 19 closely matches the shape of the central core 15 and is preferably formed by molding the conformable substrate 13 around the central core 15.

Figure 2:
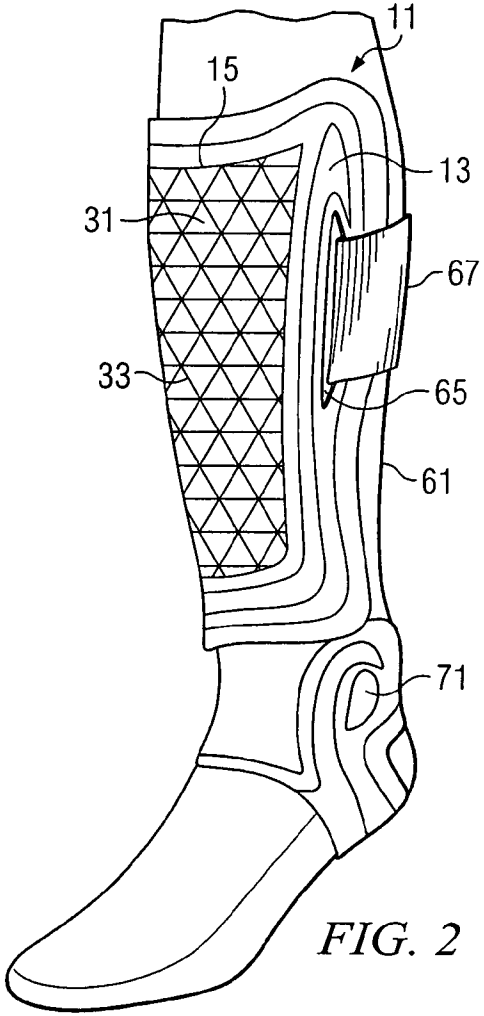
FIG. 2 depicts a perspective view of the protective guard of FIG. 1 secured to a leg of a person.

The conformable substrate 13 is preferably constructed from an elastomeric material such that the conformable substrate 13 can be easily wrapped around and shaped to the contours of a person's lower leg or shin 61 (see FIG. 2). The preferred material for the conformable substrate is Monprene MP-1880, a thermoplastic elastomer manufactured by Teknor Apex, Thermoplastic Elastomer Division of Pawtucket, R.I. Other suitable materials could include without limitation other thermoplastic elastomers, natural rubber, polyisoprene, styrene butadiene rubber, chloroprene rubber, polybutadiene, nitrile rubber, butyl rubber, ethylene propylene rubber, ethylene propylene diene rubber, chlorosulfonated polyethylene, polysulfide rubber, silicone rubber, polyurethane, and closed or open-cell neoprene or foam.

Figure 3:
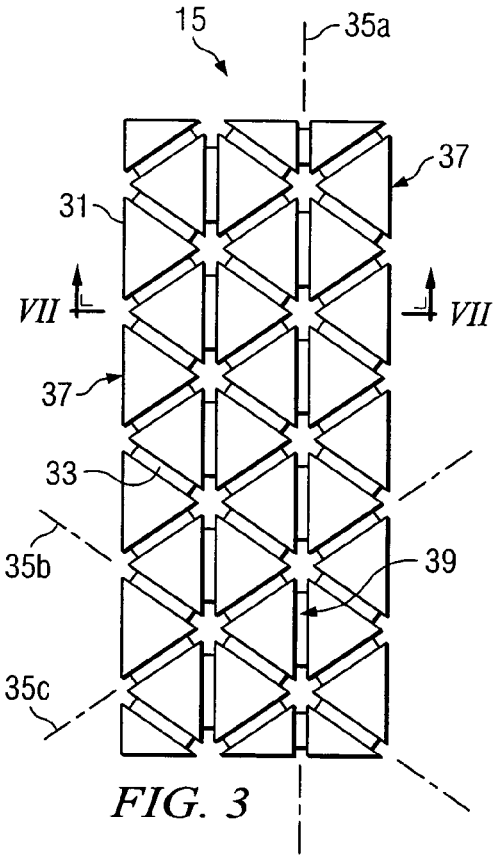
FIG. 3 illustrates a partial front view of the central core of FIG. 1, the central core including a plurality of core members.
Figure 4:
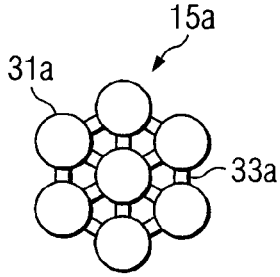
FIG. 4 depicts a partial front view of a plurality of round core members according to the principles of the present invention.

Referring to FIG. 3, the central core 15 includes a plurality of core members 31. Each core member is preferably joined by at least one hinge 33 to another of the core members 31 such that the core members 31 are capable of rotational movement relative to one another. The rotational movement between two core members typically occurs along an axis that is positioned between the core members. When hinges 33 are used to connect the core members 31, the axis of rotation corresponds to the rotational axis of the hinge. Representative axes of rotation for the central core 15 of FIG. 3 are illustrated as axis 35*a*, axis 35*b*, and axis 35*c*. The ability of the core members 31 to rotationally move relative to one another allows the central core 15 to be conformable to a shin of a person even though the material that forms the core members 31 would not necessarily be conformable if used in a single piece.

Figure 5:
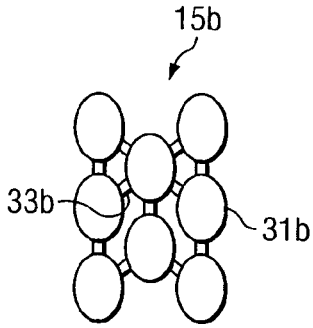
FIG. 5 illustrates a partial front view of a plurality of oval core members according to the principles of the present invention.
Figure 6:
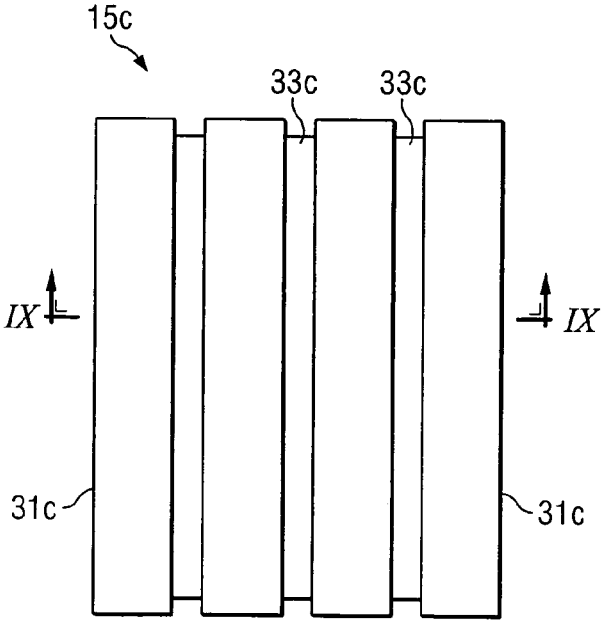
FIG. 6 depicts a partial front view of a plurality of rectangular core members according to the principles of the present invention.

Referring more specifically to FIGS. 3-6, the core members could be any shape or size. While the preferred shape is the triangular shape of core members 31 (FIG. 3), a central core 15*a* is partially shown in FIG. 4 having round core members 31*a* connected by hinges 33*a*. FIG. 5 partially illustrates a central core 15*b* having a plurality of oval core members 31*b* connected by hinges 33*b*. FIG. 6 partially illustrates a central core 15*c* having rectangular core members 31*c* connected by hinges 33*c*. Other shapes could include without limitation hexagonal, octagonal, or free-form shapes.

Figure 7:
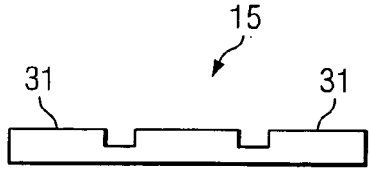
FIG. 7 illustrates a cross-sectional bottom view of the core members of FIG. 3 taken at VII-VII.

Referring to FIG. 7, the core members 31 of protective guard 11 are preferably substantially flat, rigid plates constructed from a non-elastomeric material. In a preferred embodiment, the core members 31 are made from a hard plastic material such as acrylonitrile butadiene styrene (ABS), styrene, polyethylene, polypropylene, acrylic, polyvinyl chloride (PVC), fluoroplastics, nylon, acetal, polycarbonate, polyimide, polyamide-imide, polyphenylene sulfide, polyarylates, polyethylene terephthalate, polybutylene terephthalate, polyether ether ketone, polysulfone, polyether sulfone, polyetherimide, or polyphenylene oxide. However, it should be understood that any rigid material may be used, including composites, metal, or wood. Although a non-elastomeric material is preferred, the core members 31 could even be formed from an elastomeric material if rotational movement between the core members 31 would allow the elastomeric material to better conform to the shin of a person. Preferably, the material used to form the core members 31, and thus the central core 15, is a material that is compatible with the material chosen for the conformable substrate 13. Since it is preferred to mold the conformable substrate 13 over the central core 15, it is highly desirous to use a central core material to which the conformable substrate 13 will adhere. A coating or adhesive may be applied to the central core 15 prior to the molding process to achieve additional adhesion between the central core 15 and the conformable substrate 13.

Figure 9:
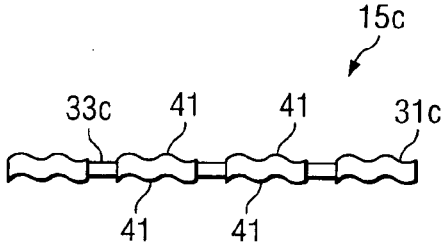
FIG. 9 illustrates a cross-sectional bottom view of the core members of FIG. 6 taken at IX-IX.

Referring to FIG. 9, the central core 15*c* of FIG. 6 is illustrated in cross section and includes core members 31*c* connected by hinges 33*c*. While it is preferred that the core members of the present invention be substantially flat so that an impact force directed to the protective guard does not damage the conformable substrate, the core members 31*c* illustrated in FIG. 9 include ridges 41. The ridges 41 may be capable of absorbing additional energy by flattening in the presence of an impact force. Other alternatives to a substantially flat core member may be provided by a core member that is slightly concave or convex in cross section. The core members could alternatively be fluid-filled capsules such as those containing air or gel, or the core members could also be a plastic or metal mesh that is hinged together similar to chain mail armor.

Figure 8:
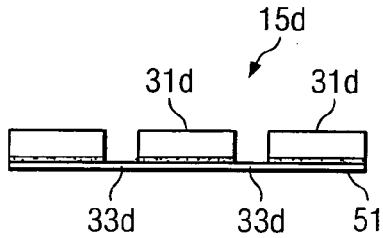
FIG. 8 depicts a cross-sectional bottom view similar to FIG. 7 of a plurality of core members according to the principles of the present invention.

Referring again to FIG. 7 and also to FIG. 8, the hinges that connect the core members could be provided in several different forms. FIG. 7 illustrates the preferred hinge 33, which is a "living hinge." The living hinge is preferably integrally attached between the core members 31 and is made from the same material as each of the core members 31. The living hinge may be created by machining or etching the core members 31 from a single sheet of material having a relatively constant thickness. The sheet of material is thinned in any region that will become a hinge. This thinning process to create the hinges 33 also creates the general shape of the core members 31. Living hinges are a strong way of maintaining a rotational connection between core members 31. The living hinges 33 allow repeated rotations between core members 31 while maintaining the relative positions of the core members 31 during the process of assembling the central core 15 and the conformable substrate 13.

Referring to FIG. 8, another option for providing hinges is illustrated in reference to a central core 15*d* having core members 31*d* and hinges 33*d*. Hinges 33*d* are formed by arranging precut core members 31*d* onto a membrane or other material 51 that includes an adhesive to secure the core members 31*d* to the membrane 51. The membrane 51 could be an adhesive tape or other film, or alternatively the membrane could be another piece of plastic or elastomer to which the core members 31*d* are bonded. Membrane 51 could be applied to both sides of the core members 31*d* or only on one side as shown in FIG. 8.

Although not illustrated, mechanical, multi-part hinges could also be used to connect adjacent core members.

Referring again to FIG. 3, certain of the core members are located in an outer perimeter region 37, while other of the core members are located in an inner region 39. The core members 31 located in the inner region 39 are preferably connected by hinges 33 along each edge of the core member 31 to each adjacent core member 31. For core members 31 located in the outer perimeter region 37, hinges 33 are only attached to one or two edges of each core member 31. However, regardless of whether a particular core member 31 is disposed within the outer perimeter region 37 or the inner region 39, it is not required that every edge of a core member 31 be connected by a hinge to another core member 31. In fact, hinges are not mandatory. Hinges simply provide a good way to maintain relative positioning of the core members 31 during assembly of the central core 15 and the conformable substrate 13. If the relative positioning of the core members 31 could be maintained without hinges, the fixation of the core members 31 within or to the conformable substrate 13 would allow the desired capability of rotational movement between adjacent core members 31. Alternatives for positioning the core members 31 are discussed below in reference to the assembly of the central core 15 and the conformable substrate 13.

Figure 10:
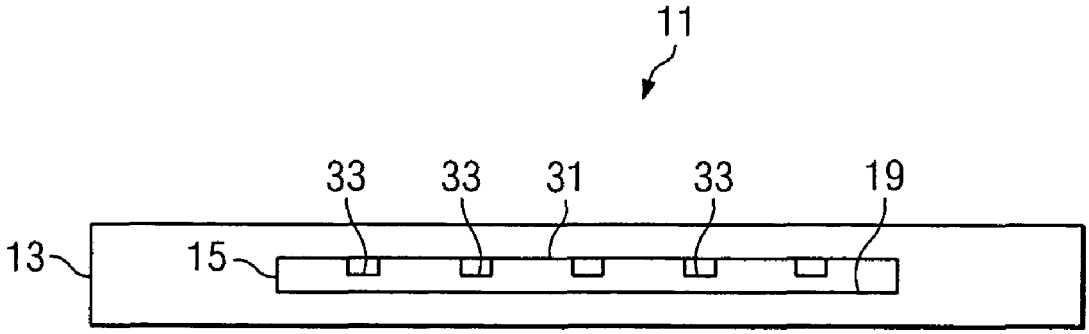
FIG. 10 depicts a cross-sectional bottom view of the conformable substrate and central core of FIG. 1 taken at X-X.

Referring to FIG. 10, the protective guard 11 preferably includes core members 31 that are completely embedded within the conformable substrate 13. As mentioned previously, a pocket 19 could be provided with an entry slot that allows for insertion of the central core 15 after the conformable substrate 13 is formed. However, it is preferred that the central core 15 be molded within the conformable substrate 13, which would automatically form a pocket 19 around the central core 15. It is preferred that hinges 33 are present between the core members 31 to maintain the relative position of the core members 31 during the molding process. It is possible, however, that the core members 31 be individually placed during the molding process to eliminate the need for the hinges 33. After the molding process, the relative positions (e.g. spacing) of the core members 31 would be fixed within the conformable substrate 13, yet the core members 31 would still be capable of rotational movement relative to one another.

Figure 11:
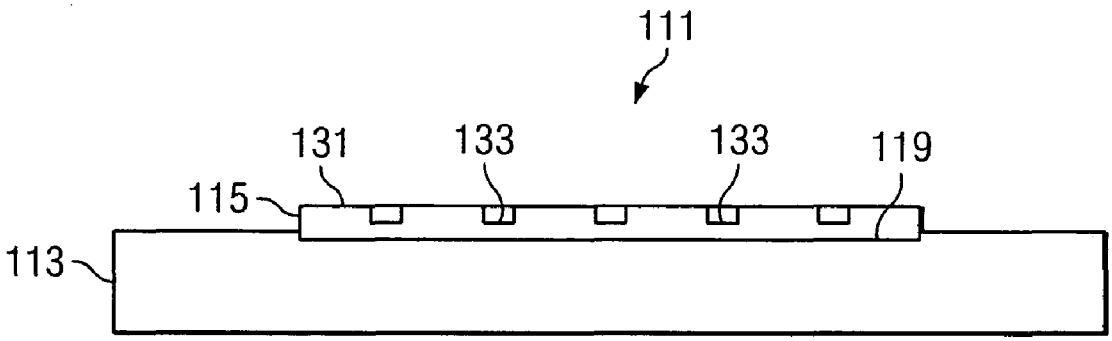
FIG. 11 illustrates a cross-sectional bottom view similar to FIG. 10 of a conformable substrate and central core according to the principles of the present invention.

Referring to FIG. 11, a protective guard 111 having a conformable substrate 113 and a central core 115 is illustrated. The central core 15 includes a plurality of core members 131 connected by hinges 133. The central core 115 is partially embedded within a pocket 119 of the conformable substrate 113, thereby exposing the core members 131 near a surface of the conformable substrate 113. The central core 115 may be secured to the conformable substrate 113 by the embedding process, or a bonding agent or other adhesive may be used to further secure the central core 115. As discussed previously in reference to FIG. 10, the hinges 133 between core members 131 could be eliminated if the core members 131 were individually placed during the assembly process. Individual core members 131 could be placed during the molding of the conformable substrate 113, or the core members could be bonded within the pocket 119 of the conformable substrate 113 after the molding process is complete. After securing the core members 131 to the conformable substrate 113, the relative positions (e.g. spacing) of the core members 131 would be fixed, yet the core members 131 would still be capable of rotational movement relative to one another.

Figure 12:
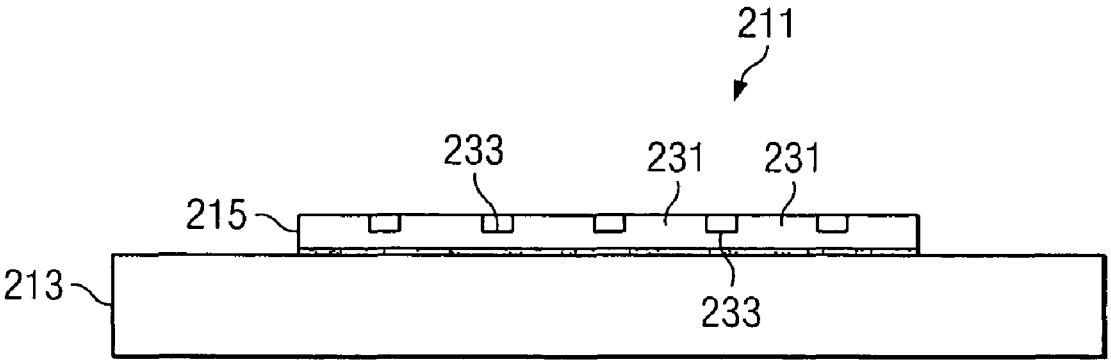
FIG. 12 depicts a cross-sectional bottom view similar to FIG. 10 of a conformable substrate and central core according to the principles of the present invention.

Referring to FIG. 12, a protective guard 211 having a conformable substrate 213 and a central core 215 is illustrated. The central core 215 includes a plurality of core members 231 connected by hinges 233. The central core 215 is bonded to a surface of the conformable substrate 213. The central core 215 is preferably secured to the conformable substrate 213 by a bonding agent or adhesive. As discussed previously with reference to FIGS. 10 and 11, the hinges 233 between core members 231 could be eliminated if the core members 231 were individually placed during the bonding process. After securing the core members 231 to the conformable substrate 213, the relative positions (e.g. spacing) of the core members would be fixed, yet the core members would still be capable of rotational movement relative to one another.

In use, the protective guard 11, 111, 211 of the present invention provides impact protection for an extremity or other body part of a person. As shown in FIG. 2, the protective guard 11 is conformable to the shin and lower leg 61 of a person. The conformable substrate 13 and the central core 15 combine to provide superior impact protection. While the conformable substrate 13 by itself is conformable to a leg or other body part, the more rigid characteristics of the material used in the central core 15 would normally not be easily conformable to the person's leg. However, by separating the central core 15 into a plurality of core members 31 and by allowing the core members 31 to be rotationally movable relative to one another, the central core 15 as a whole is also conformable to the leg of the person. An attachment aperture 65 is provided on each side of the conformable substrate 13 to allow protective guard 11 to be attached to the person's leg with a strap 67 routed through the attachment aperture 65. An ankle guard 71 may also be provided to wrap around the ankle of the person. The ankle guard 71 could include a central core, but preferably is formed solely from the conformable substrate used with protective guard 11, 111, 211. Similarly, the protective guard itself could be formed solely from the conformable substrate and used without the central core. If only the conformable substrate is used, the material may be thicker in areas of predicted impact or may be formed from two or more elastomers having different durometers (i.e. a multi-durometer conformable substrate).

It should be noted that the protective guard 11, 111, 211 of the present invention could be used to protect body parts other than the lower leg of a person including without limitation forearms, elbows, and knees. The protective guard 11, 111, 211 could also be used to protect body parts of non-human animals as well.

It should be apparent from the foregoing that an invention having significant advantages has been provided. While the invention is shown in only a few of its forms, it is not just limited but is susceptible to various changes and modifications without departing from the spirit thereof.

I claim:

1. A shin protector device comprising:

an elastomeric substrate having a pocket disposed therein; and a central core having a plurality of rigid plates disposed within the pocket, a first of the plates being joined by at least one hinge to a second of the plates;

wherein the hinge is a living hinge formed from the same material as the rigid plates.

2. The shin protector device according to claim 1, wherein each of the plates is joined by at least one hinge to another of the plates.

3. The shin protector device according to claim 2, wherein the joining of the plates allows multidirectional rotation of the central core such that both the central core and the elastomeric substrate are conformable to the shin of a person.

4. The shin protector device according to claim 1, wherein the pocket is formed by molding the elastomeric substrate around the central core.

5. The shin protector device according to claim 1, wherein the pocket is accessible through an entry slot to allow insertion and removal of the central core.

6. The shin protector device according to claim 1, wherein the plates are triangular in shape.

7. The shin protector device according to claim 6, wherein:

some of the rigid plates are disposed in an outer perimeter region and others of the rigid plates are disposed in an inner region; and each of the rigid plates in the inner region is hingedly attached on each of three edges to an adjacent rigid plate.

8. The shin protector device according to claim 1, wherein the elastomeric substrate is a thermoplastic elastomer.

9. A shin protector device comprising:

a conformable substrate; and a plurality of core members disposed adjacent to a surface of the conformable substrate and arranged such that a first of the core members is rotationally movable about at least one axis relative to a second of the core members;

wherein the first of the core members is hingedly connected to the second of the core members by a hinge;

wherein the hinge is made from the same material as the first of the core members and the second of the core members.

10. The shin protector device according to claim 9, wherein the core members are arranged such that the core members, as a whole, are conformable to the shin of the person.

11. The shin protector device according to claim 9, wherein the joining of the core members allows multidirectional rotation of the plurality of core members such that both the plurality of core members and the conformable substrate are conformable to the shin of a person.

12. The shin protector device according to claim 9, wherein each of the plurality of core members is hingedly connected to at least one other of the plurality of core members to allow multidirectional rotation of the plurality of core members such that the plurality of core members and the conformable substrate are conformable to the shin.

13. The shin protector device according to claim 9, wherein the conformable substrate is a thermoplastic elastomer.

* * * * *